US006142589A

United States Patent [19]

Wang

[11] Patent Number: 6,142,589

[45] Date of Patent: Nov. 7, 2000

[54] COMBINATION STORAGE RACK

[76] Inventor: Wen-Tsan Wang, P.O. Box 82-144, Taipei, Taiwan

[21] Appl. No.: 09/422,641

[22] Filed: Oct. 22, 1999

[51] Int. Cl.[7] ..... A47B 47/00

[52] U.S. Cl. ..... 312/6; 312/3

[58] Field of Search ..... 312/3, 4, 5, 6, 312/265.1, 265.4; 190/13 R; 135/121, 128, 904

[56] References Cited

U.S. PATENT DOCUMENTS

| | | | |
|---|---|---|---|
| 1,640,083 | 8/1927 | Ladd | 312/6 X |
| 3,722,905 | 3/1973 | Solomon | 312/6 X |
| 3,760,943 | 9/1973 | Reader | 312/3 X |
| 5,622,415 | 4/1997 | Felsentthal | 312/3 X |

*Primary Examiner*—Janet M. Wilkens
*Attorney, Agent, or Firm*—A & J

[57] ABSTRACT

A combination storage rack, which includes a frame structure, which is formed of two rectangular open frames each having vertically aligned pegs in four corners thereof, and four support tubes respectively fastened to the pegs between the rectangular open frames, and a collapsible shell mounted in the frame structure and defining a plurality of storage chambers, the shell having a top face panel supported above the frame structure, and loop and hook materials for securing the body of the shell to the rectangular open frames of the frame structure.

4 Claims, 4 Drawing Sheets

COMBINATION STORAGE RACK

BACKGROUND OF THE INVENTION

The present invention relates to a combination storage rack, which is comprised of a collapsible frame structure, and a shell detachably mounted in the frame structure for keeping storage items.

Regular home use storage racks are generally made of wood, plastics, or metal, or comprised of a rigid frame structure and a plastic shell supported on the frame structure. These storage racks are commonly not collapsible when set up. Because setting up these storage racks require special techniques, these storage racks do not fit the requirement for DIY (Do-It-Yourself), and are set up in factory. Because these storage racks are not collapsible, much storage space is required when delivering these storage racks to distributors, or keeping these storage racks in a warehouse.

SUMMARY OF THE INVENTION

It is one object of the present invention to provide a combination storage rack, which is collapsible. It is another object of the present invention to provide a combination storage rack, which fits DIY (Do-It-Yourself) requirement, so that the consumer can assemble the combination storage rack by oneself. It is still another object of the present invention to provide a combination storage rack, which is inexpensive to manufacture According to one aspect of the present invention, the combination storage rack comprises a frame structure, which is formed of two rectangular open frames each having vertically aligned pegs in four corners thereof, and four support tubes respectively fastened to the pegs between the rectangular open frames, and a collapsible shell mounted in the frame structure and defining a plurality of storage chambers, the shell having a top face panel supported above the frame structure, and a plurality or fastening devices for securing the body of the shell to the rectangular open frames of the frame structure. According to another aspect of the present invention, the fastening devices each are comprised of a strip of loop material fixedly fastened to the shell at one side, and a strip of hook material suspended from the strip of loop material for fastening to the strip of loop material to secure the shell to the frame structure.

DETAILED DESCRIPTION OF THE PREFERRED EMBODIMENT

Figure 1:
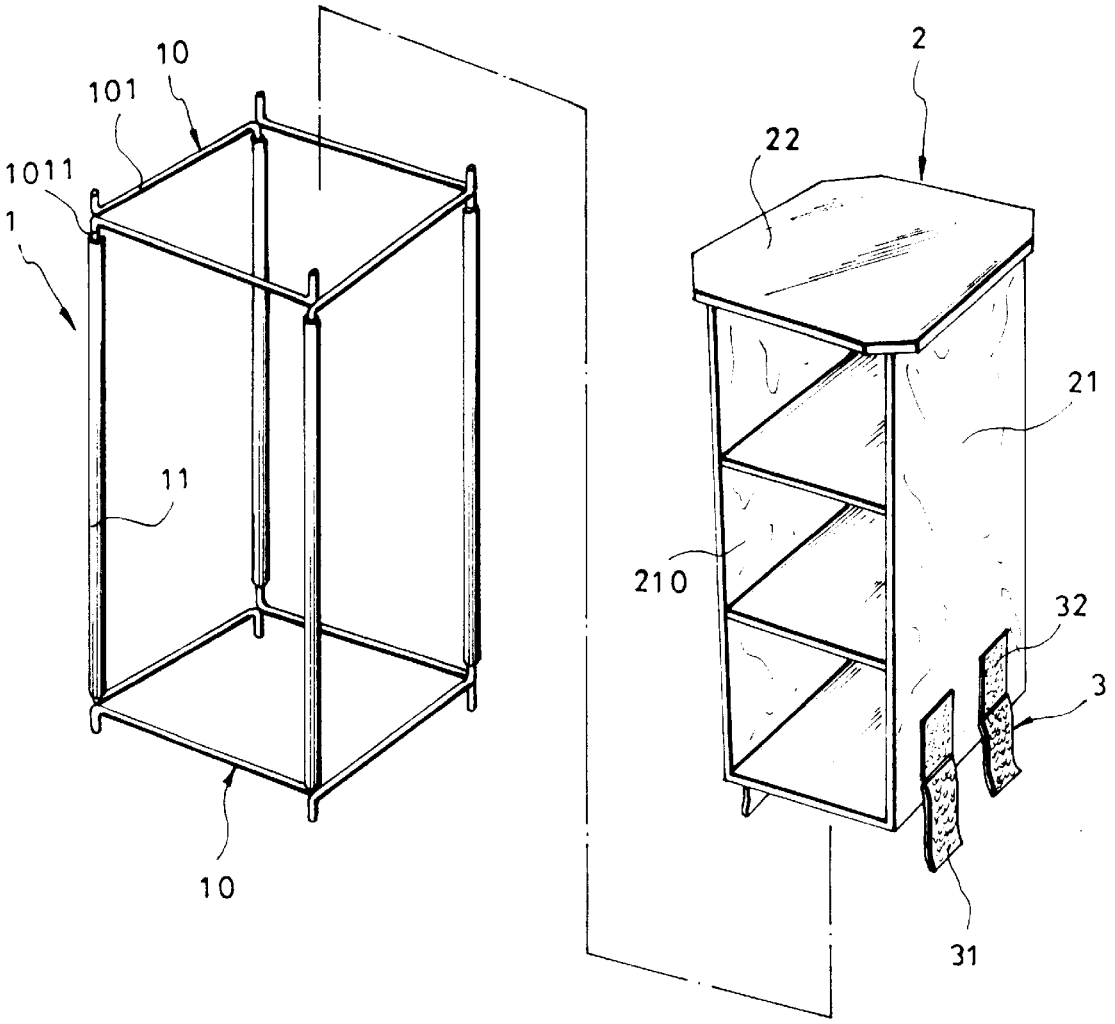
FIG. 1 an exploded view of a combination storage rack according to one embodiment of the present invention.

Referring to FIG. 1, a combination storage rack in accordance with the present invention is generally comprised of a frame stricture 1, and a shell 2.

Figure 2:
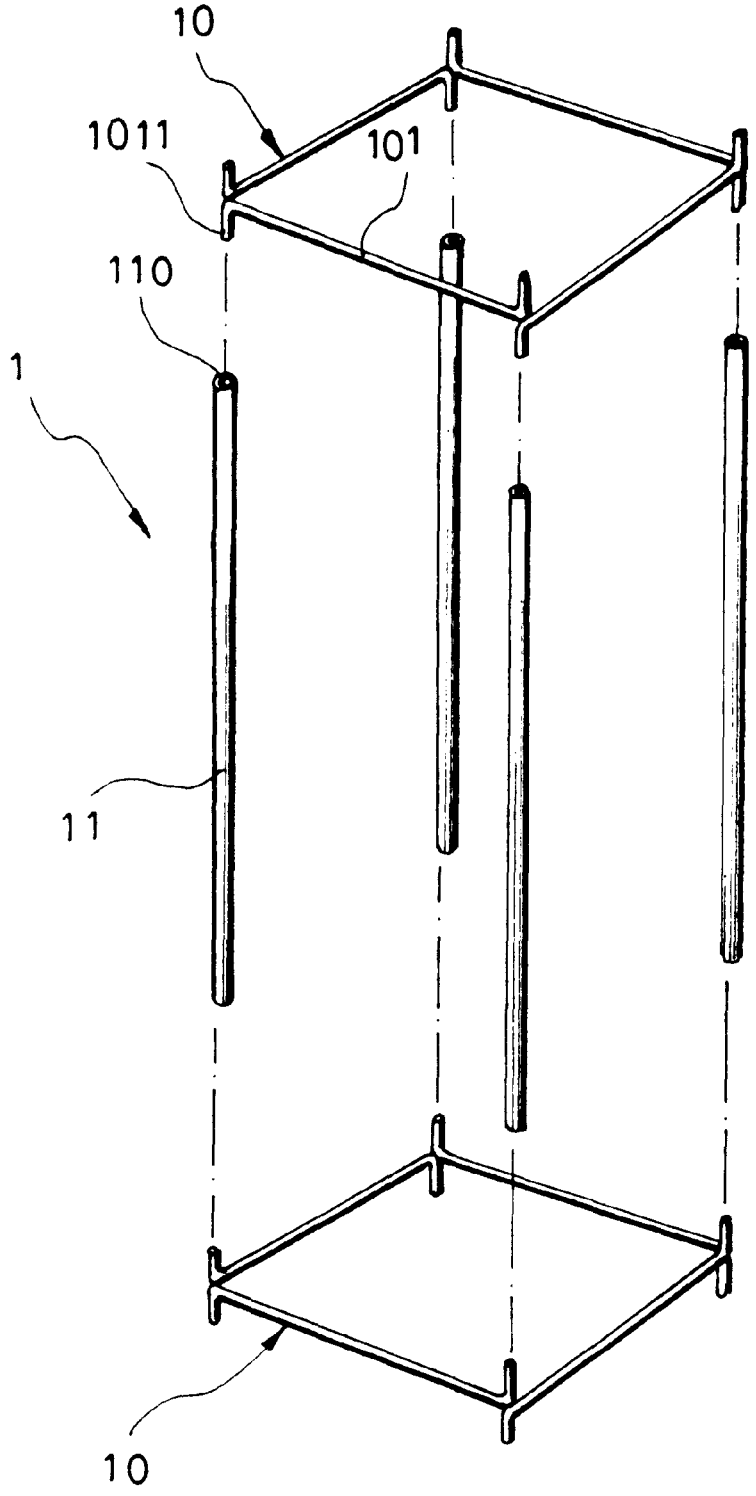
FIG. 2 is an exploded view of the frame structure shown in FIG. 1.

Referring to FIG. 2, the frame structure 1 is comprised of two rectangular open frames 10, and four support tubes 11. Welding four substantially Z-shaped rod members 101 together makes a rectangular open frame 10. Each rod member 101 comprises two vertical pegs 1011 disposed at two opposite ends and extended in reversed directions. After four rod members 101 have been welded together to form a rectangular open frame 1, the vertical peg 1011 at one end of one rod member 101 is longitudinally aligned with the vertical peg 1011 at one end of another rod member 101. The support tubes 11 are connected in parallel between the rectangular open frames 10 in the four corners. The downwardly extended four vertical pegs 1011 of the rectangular open frame 10 at the top side and the upwardly extended four vertical pegs 1011 of the rectangular open frame 10 at the bottom side are respectively fitted into the bore 110 of each of the support tubes 11 from two opposite ends.

Referring to FIG. 1 again, the shell 2 comprises a body 21 defining a plurality of storage chambers 210, and a top face panel 22. The dimension of the top face panel 22 is greater than the cross section of the frame structure 1, so that the top face panel 22 can be supported on the rectangular open frame 10 at the topside of the frame structure 1. Fastening devices 3 are provided at the body 21 of the shell 2 at two opposite lateral sides. The fastening devices 3 each are comprised of a strip of loop material 32 fixedly fastened to one lateral side wall of the body 21 of the shell 2, and a strip of hook material 31 longitudinally connected to the strip of loop material 32.

Figure 3:
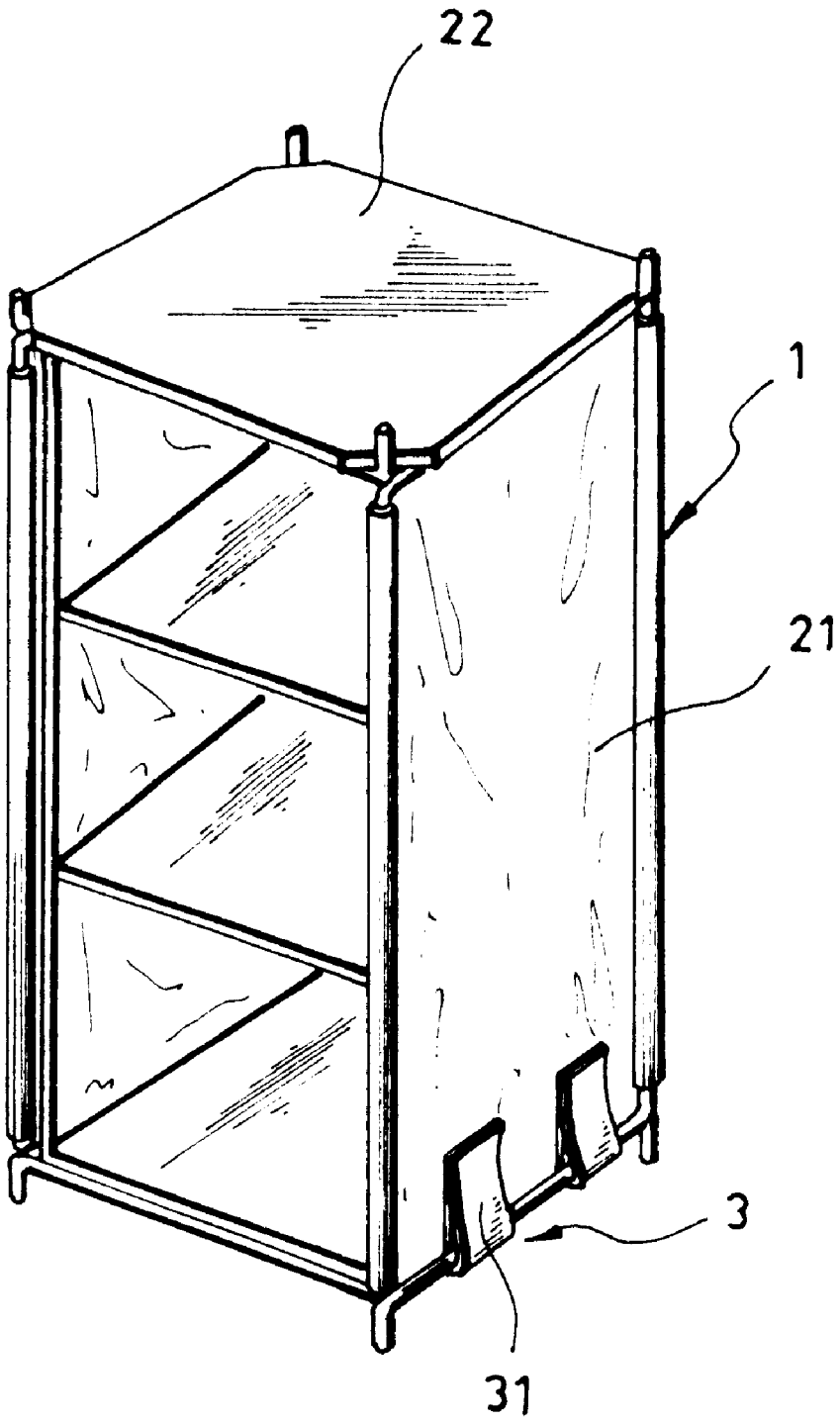
FIG. 3 shows the combination storage rack of FIG. 1 assembled.

Referring to FIG. 3 and FIG. 1 again, the body 21 of the shell 2 is inserted into the frame structure 1, enabling the top face panel 22 to be supported above the rectangular open frame 10 at the top side of the frame structure 1, and then the strips of hook material 31 are fastened to the respective strips of loop materials 32 to secure the body 21 of the shell 2 to the rod members 101 of the rectangular open frame 10 at the bottom side of the frame structure 1. By disengaging the strips of hook material 31 from the respective strips of loop material 32, the shell 2 can then be removed from the frame structure 1.

Figure 4:
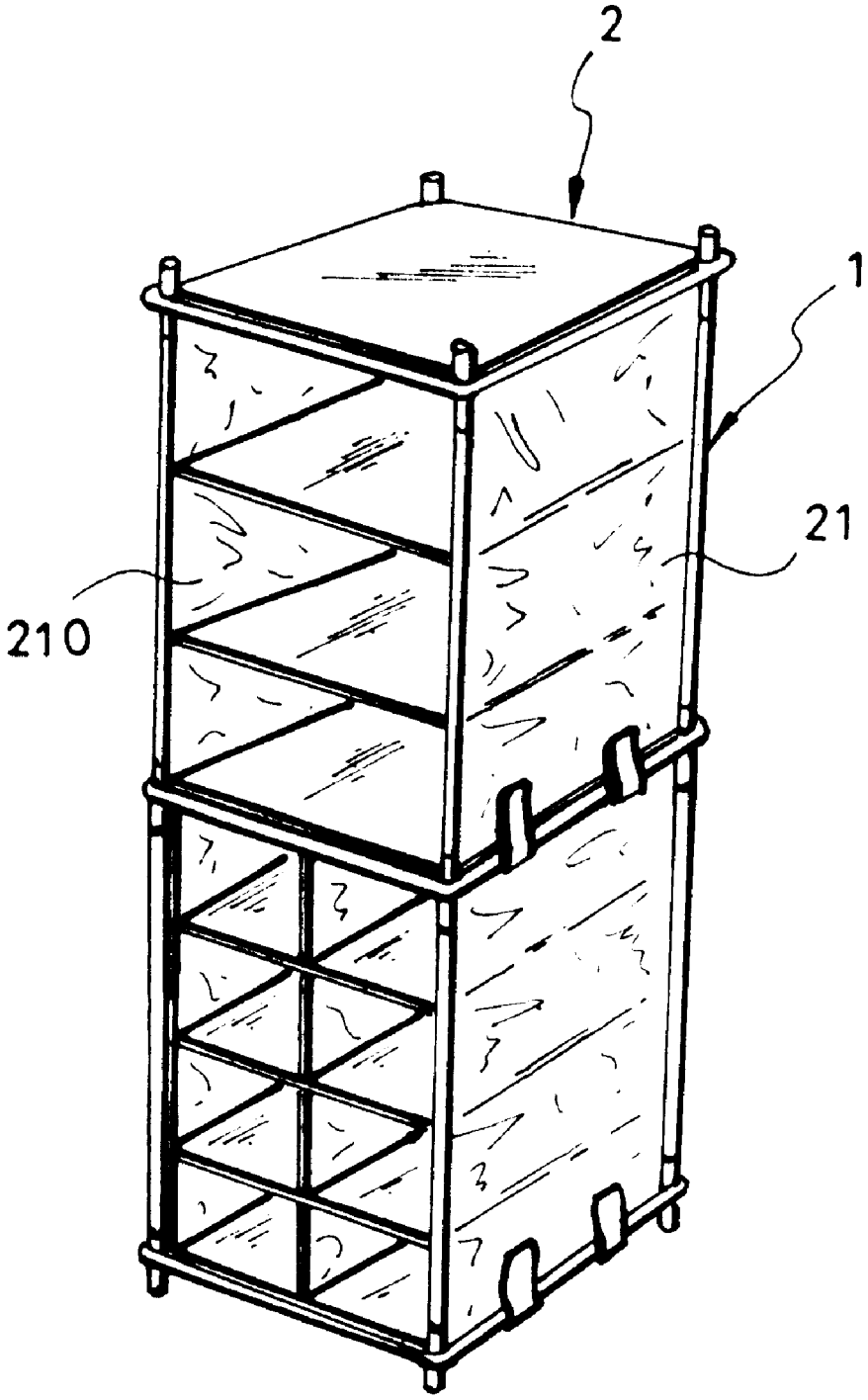
FIG. 4 illustrates an alternate form of the present invention.

Referring to FIG. 4, the shell 2 may be variously racks may be arranged in a stack. Because the shell 2 is collapsible and can easily detachably fastened to the frame structure 1, and because the frame structure 1 is comprised of two rectangular open frames 10 are four support tubes 11 detachably fastened together, the combination storage rack can be packed in a collapsed condition convenient for delivery and storage, and the consumer can assemble the combination storage rack by oneself.

It is to be understood that the drawings are designed for purposes of illustration only, and are not intended for use as a definition of the limits and scope of the invention disclosed.

What the invention claimed is:

1. A combination storage rack comprising:

a frame structure, said frame structure comprising two rectangular open frames, and four support tubes connected between said rectangular open frames in four corners, said rectangular open frames each comprising four vertically aligned pegs in four corners thereof, said support tubes each having two opposite ends respectively coupled to the vertical pegs at said rectangular open frames; and a shell mounted in said frame structure, said shell comprising a body inserted into said frame structure and defining a plurality of storage chambers, a top face panel provided at said body at a top side and supported above said frame structure, and a plurality of fastening devices for securing said body to said frame structure.

2. The combination storage rack of claim 1 wherein said rectangular open frames of said frame structure each are comprised of four substantially Z-shaped rod members welded together, said rod members each having two angled ends extended in reversed directions.

3. The combination storage rack of claim 1 wherein said fastening devices each are comprised of a strip of loop material fixedly fastened to said body of said shell, and a strip of hook material extended from one end of said strip of loop material outside said body of said shell.

4. The combination storage rack of claim 3 wherein said fastening devices are symmetrically provided at two opposite lateral sides of said body of said shell.

* * * * *